US010218132B2

(12) United States Patent
Balcer et al.

(10) Patent No.: US 10,218,132 B2
(45) Date of Patent: Feb. 26, 2019

(54) POST-LESS, SELF-GRIPPING CONNECTOR FOR A COAXIAL CABLE

(71) Applicant: CORNING OPTICAL COMMUNICATIONS RF LLC, Glendale, AZ (US)

(72) Inventors: Anders Balcer, Vordingborg (DK); Michael Ole Matzen, Vordingborg (DK); Michael Meister, Langebaek (DK); Thomas Dewey Miller, Peoria, AZ (US); Jens Petersen, Vordingborg (DK); Nikolaj Slobodziuk, Vordingborg (DK)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/728,109

(22) Filed: Oct. 9, 2017

(65) Prior Publication Data

US 2018/0131143 A1 May 10, 2018

Related U.S. Application Data

(60) Provisional application No. 62/417,618, filed on Nov. 4, 2016.

(51) Int. Cl.
*H01R 9/05* (2006.01)
*H01R 24/56* (2011.01)
(Continued)

(52) U.S. Cl.
CPC ..... *H01R 24/56* (2013.01); *H01R 9/0524* (2013.01); *H01R 9/0527* (2013.01);
(Continued)

(58) Field of Classification Search
CPC ..... H01R 24/38; H01R 9/05
(Continued)

(56) References Cited

U.S. PATENT DOCUMENTS 4,575,274 A 3/1986 Hayward
4,834,675 A 5/1989 Samchisen
(Continued)

FOREIGN PATENT DOCUMENTS

GB 2504347 A 1/2014

OTHER PUBLICATIONS

International Search Report and Written Opinion PCT/US2017/059200 dated Jan. 22, 2018.

*Primary Examiner* — Phuong Dinh
(74) *Attorney, Agent, or Firm* — Tamika A. Crawl-Bey

(57) ABSTRACT

A post-less, self-gripping coaxial cable connector for tool-less attachment to an end of a coaxial cable is disclosed. The coaxial cable connector has a body having a forward end and a rearward end and a longitudinal opening. A retainer positioned in the body has a forward section, a rearward section, and a bore. A ring is movably disposed in the retainer. A gripping member having at least one spring finger is friction fit to the body and is radially inwardly biased in a predisposed orientation. The ring has a pusher feature configured to axially move the ring upon force being applied to the pusher feature by a coaxial cable received by the body causing the gripping member to engage the jacket of the coaxial cable when the coaxial cable is installed in the coaxial cable connector.

25 Claims, 6 Drawing Sheets

(51) Int. Cl.
*H01R 13/58* (2006.01)
*H01R 13/585* (2006.01)
*H01R 103/00* (2006.01)

(52) U.S. Cl.
CPC ..... *H01R 13/585* (2013.01); *H01R 13/5825* (2013.01); *H01R 2103/00* (2013.01)

(58) Field of Classification Search
USPC ..... 439/578, 394, 585
See application file for complete search history.

(56) References Cited

U.S. PATENT DOCUMENTS

| | | | | |
|---|---|---|---|---|
| 5,342,218 | A | 8/1994 | McMills et al. | |
| 7,288,002 | B2 | 10/2007 | Rodrigues et al. | |
| 7,303,435 | B2 | 12/2007 | Burris et al. | |
| 7,351,101 | B1 | 4/2008 | Montena | |
| 7,371,113 | B2 | 5/2008 | Burris et al. | |
| 7,967,634 | B1 | 6/2011 | Hsia | |
| 2004/0031144 | A1 | 2/2004 | Holland | |
| 2013/0143439 | A1 | 6/2013 | Nugent et al. | |
| 2013/0178096 | A1* | 7/2013 | Matzen | H01R 24/38 439/578 |
| 2014/0106613 | A1* | 4/2014 | Burris | H01R 9/0524 439/578 |
| 2014/0106614 | A1 | 4/2014 | Burris et al. | |
| 2014/0342605 | A1* | 11/2014 | Burris | H01R 9/05 439/578 |

* cited by examiner

POST-LESS, SELF-GRIPPING CONNECTOR FOR A COAXIAL CABLE

CROSS REFERENCE TO RELATED APPLICATIONS

This application claims the benefit of priority of U.S. Provisional Application Ser. No. 62/417,618, filed Nov. 4, 2016, the content of which is relied upon and incorporated herein by reference in its entirety.

FIELD

The disclosure relates generally to coaxial cable connectors, including F-type coaxial cable connectors for use with minimally prepared coaxial cables, including post-less, self-gripping coaxial cable connectors that tool-lessly attach to the end of a coaxial cable.

BACKGROUND

Coaxial cable connectors, such as F-connectors, are used to attach coaxial cables to another object such as an appliance or junction having a terminal adapted to engage the connector. For example, F-connectors are often used to terminate a drop cable in a cable television system. The coaxial cable typically includes an inner conductor surrounded by a dielectric layer, which is in turn surrounded by an outer conductor in the form of a conductive grounding foil and/or braid defining an outer conductive grounding sheath. The outer conductive grounding sheath is itself surrounded by a protective outer jacket. The F-connector is typically secured over the prepared end of the jacketed coaxial cable, allowing the end of the coaxial cable to be connected with a terminal block, such as by a threaded connection with a threaded terminal of a terminal block.

In the case of most of the types of connectors, the coaxial cable must be prepared by stripping back the outer jacket to expose the outer conductive grounding sheath and inner conductor, then further requires that the outer conductive grounding sheath be folded back, or everted. The folded back or everted outer conductive grounding sheath facilitates the electrical continuity with the coaxial cable connector when the coaxial cable is installed thereon. In this manner, grounding continuity from the coaxial cable through the coaxial cable connector to the terminal block may be established. Without such effective grounding continuity, spurious signals may compromise the quality or effectiveness of the signals being transmitted by the coaxial cable. However, since the conductive grounding sheath typically is a braided metallic material, the step of flaring and folding the conductive grounding sheath over the outer jacket is a difficult, time consuming and painstaking process. Further, the preparation of the coaxial cable is typically performed manually by an installer using hand tools, and, as such, the results of such preparation may not be consistent between different installers or different coaxial cable connectors. As a non-limiting example, small fragments of the outer braid may break off affecting the grounding continuity or possibly causing an electrical short in the coaxial cable connector or other nearby electrical systems. Additionally, due to the need to manually perform the coaxial cable preparation, the small fragments may cut and/or enter the skin of the cable installer resulting in a safety or health concern.

Once the coaxial cable is prepared, it is installed in the coaxial cable connector in a manner so that a post is inserted under the jacket of the coaxial cable. Next the coaxial cable connector is axially compressed using a compression tool. The axial compression of the coaxial cable connector causes an internal component to move radially inwardly and compress against the outer surface of the jacket. A number of manufacturers provide compression tools for axially compressing a cable connector. Such compression tools are hand tools requiring the installer to correctly manipulate the tool to provide the necessary axial compression force to result in the appropriate radial inward compression of the internal component. Accordingly, the need to prepare the coaxial cable and the attendant issues involving such preparation as noted above, and the requirement to compress the coaxial cable connector using a compression tool, takes time and patience when installing a coaxial cable connector on the end of a coaxial cable.

Consequently, there is an unresolved need for a coaxial cable connector that terminates the coaxial cable without requiring the flaring or folding of the braided outer conductive grounding sheath of the coaxial cable and without requiring the use of a compression tool.

No admission is made that any reference cited herein constitutes prior art. Applicant expressly reserves the right to challenge the accuracy and pertinence of any cited documents.

SUMMARY

One embodiment of the disclosure relates to a post-less, self-gripping coaxial cable connector for tool-less attachment to an end of a coaxial cable, the coaxial cable comprising an inner conductor, a dielectric surrounding the inner conductor, an outer conductor surrounding the dielectric, and a jacket surrounding the outer conductor. The coaxial cable connector comprises a body having a forward end and a rearward end and a longitudinal opening therethrough. The coaxial cable connector further comprises a retainer positioned in the body, wherein the retainer comprises a forward section, a rearward section, and a bore extending therethrough. The coaxial cable connector further comprises a ring movably disposed in the rearward section of the retainer, the ring comprising a side having an outer surface, an inner surface, and a pusher feature. The coaxial cable connector further comprises a gripping member friction fit to the body proximal the rearward end, wherein the gripping member comprises a base and at least one spring finger extending longitudinally from the base, and wherein the at least one spring finger is radially inwardly biased in a predisposed orientation. The pusher feature of the ring is configured to axially move the ring upon force being applied to the pusher feature by a coaxial cable received by the body. The gripping member is configured to engage the jacket of the coaxial cable when the ring is axially moved such that the coaxial cable is installed in the coaxial cable connector and the coaxial cable connector is tool-lessly attached to the coaxial cable thereby.

Another embodiment of the disclosure relates to a coaxial cable connector for attachment to an end of a coaxial cable, the coaxial cable comprising an inner conductor, a dielectric surrounding the inner conductor, an outer conductor surrounding the dielectric, and a jacket surrounding the outer conductor. The coaxial cable connector comprises a body having a forward end and a rearward end, wherein an internal surface extends between the forward end and the rearward end. The internal surface defines a longitudinal opening along a longitudinal axis and the body comprises a cable receiving area proximal the rearward end. The coaxial cable connector further comprises a retainer positioned in the body proximal the forward end of the body, wherein the retainer comprises a forward section, a rearward section, and a bore extending through the retainer along the longitudinal axis and opening at the forward section at a forward face and the rearward section at a rear opening, and wherein the forward section is friction fit to the internal surface of the body at the forward end of the body. The coaxial cable connector further comprises a ring disposed in the rearward section of the retainer, the ring comprising a side with an outer surface and an inner surface, the inner surface defining a hollow space extending through the ring, and a pusher feature, wherein the ring is axially movable from a first location to a second location. The coaxial cable connector further comprises a gripping member friction fit to the body proximal the rearward end, wherein the gripping member comprises a base and at least one spring finger extending longitudinally from the base, and wherein the at least one spring finger is radially inwardly biased in a predisposed orientation. In a first state, the ring is disposed in the first location at the rear opening of the retainer with the side extending at least partially therethrough, and wherein the at least one spring finger is engaged with the outer surface of the side of the ring, and wherein the at least one spring finger is forced radially outwardly thereby. In a second state, the ring is in the second location positioned out of the gripping member, and wherein the at least one spring finger is disengaged from the outer surface of the ring, and wherein the at least one spring finger is allowed to move radially inwardly to its predisposed orientation.

Yet another embodiment of the disclosure relates to a post-less, self-gripping coaxial cable connector for tool-less attachment to an end of a coaxial cable. The coaxial cable comprises an inner conductor, a dielectric surrounding the inner conductor, an outer conductor surrounding the dielectric, and a jacket surrounding the outer conductor. The coaxial cable connector comprises a body having a forward end and a rearward end, wherein an internal surface extends between the forward end and the rearward end, the internal surface defining a longitudinal opening along a longitudinal axis, and wherein the body comprises a cable receiving area proximal the rearward end. The coaxial cable connector further comprises a retainer positioned in the body proximal the forward end of the body. The retainer comprises a forward section, a rearward section, and a bore extending through the retainer along the longitudinal axis and opening at the forward section at a forward face and at the rearward section at a rear opening, and wherein the forward section is friction fit to the internal surface of the body at the forward end of the body. The coaxial cable connector further comprises a ring movably disposed in the rearward section of the retainer proximal the rear opening, the ring comprising a side and a pusher feature, wherein the side has an outer surface and an inner surface, the inner surface defining a hollow space extending through the ring, and wherein the side extends out from the rear opening of the retainer, and wherein the ring is axially movable from a first location to a second location by force applied to the pusher feature. The coaxial cable connector further comprises a gripping member friction fit to the body proximal the rearward end, wherein the gripping member comprises a base and at least one spring finger extending from the base, and wherein the at least one spring finger is radially inwardly biased in a predisposed orientation. In a first state, the ring is in the first location and wherein the side of the ring extended out from the retainer is positioned within the gripping member, and wherein the at least one spring finger is engaged with the outer surface of the ring, and wherein the at least one spring finger is forced radially outwardly thereby, and wherein the body is configured to receive at the cable receiving area a coaxial cable and allow the coaxial cable to advance through the gripping member and into the ring at the rearward section of the retainer, and the jacket of the coaxial cable to contact the pusher feature of the ring in the rearward section, and the inner conductor, dielectric, and outer conductor of the coaxial cable to advance from the rearward section of the retainer into the forward section of the retainer. In a second state, the ring is configured to axially move to the second location wherein the side of the ring is positioned out of the gripping member as the coaxial cable is advanced in the body, and wherein the dielectric of the coaxial cable and at least a portion of the outer conductor of the coaxial cable position flush with the forward face of the retainer, and wherein the inner conductor extends forwardly of the forward face of the retainer, and wherein the at least one spring finger is disengaged from the outer surface of the ring and is allowed to move radially inwardly toward its predisposed orientation and engage the jacket of the coaxial cable, and wherein the coaxial cable connector is tool-lessly attached to the coaxial cable thereby.

Still yet another embodiment of the disclosure relates to a method for tool-lessly attaching a post-less, self-gripping coaxial cable connector to a coaxial cable. The method comprises providing a coaxial cable comprising an inner conductor, a dielectric surrounding the inner conductor, an outer conductor surrounding the dielectric, and a jacket surrounding the outer conductor. The method further comprises preparing the coaxial cable by exposing a first predetermined length of the inner conductor, and a second predetermined length of the outer conductor, the outer conductor covering the dielectric. The method further comprises inserting the prepared coaxial cable into a body of a coaxial cable connector at a base of a gripping member friction fit to the body proximal to a rearward end of the body, wherein the coaxial cable connector is in a first state. The method further comprises advancing the coaxial cable through a base of the gripping member and through at least one spring finger extending longitudinally from the base of the gripping member and into a ring movably disposed in a first location in a rearward section of a retainer, the retainer being friction fit to the body at a forward section of the body, wherein the ring comprises a pusher feature for axially moving the ring from the first location to a second location. The method further comprises axially moving the ring from the first location to the second location by the jacket of the coaxial cable forcing the pusher feature, wherein the ring in the second location is positioned in a forward section of the retainer, wherein the retainer comprises a forward face at the forward section, and wherein the coaxial cable connector is in a second state, wherein the dielectric of the coaxial cable and at least a portion of the outer conductor of the coaxial cable position flush with the forward face of the retainer, and wherein the inner conductor extends forwardly of the forward face of the retainer, and wherein the at least one spring finger engages the jacket of the coaxial cable, and wherein the coaxial cable connector is tool-lessly attached to the coaxial cable thereby.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1A:
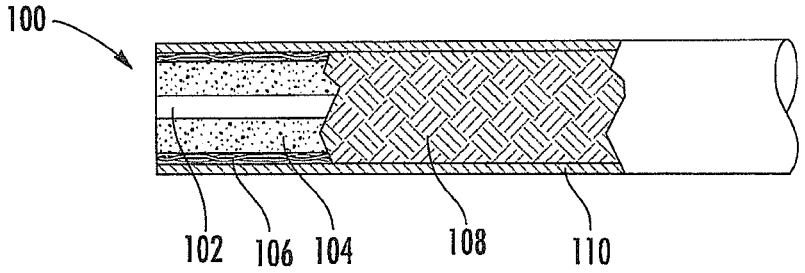
FIG. 1A PRIOR ART
FIG. 1A is a partial cross section of a coaxial cable useful for description of the various cable constituents.
Figure 1B:
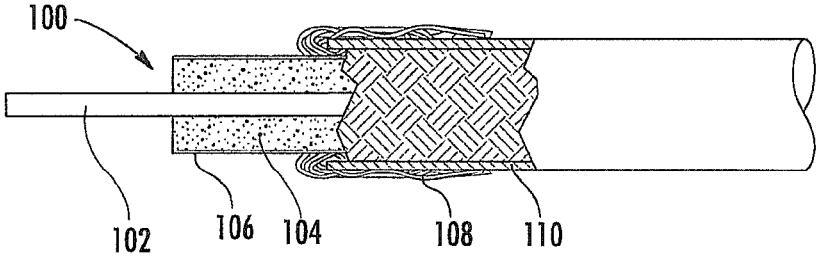
FIG. 1B PRIOR ART
FIG. 1B is a partial cross-sectional view of a prepared coaxial cable using conventional preparation methods.

Referring to FIGS. 1A and 1B, a conventional coaxial cable 100 is illustrated as well as the method in which the end of the coaxial cable 100 is prepared. Referring to FIG. 1A, the coaxial cable 100 has an inner conductor 102 that is surrounded by a dielectric layer 104. The dielectric layer (or dielectric) 104 may also have a foil or other metallic covering 106. Coaxial cable 100 then has a braided outer conductor 108 which is covered and protected by a jacket 110. Typically, to prepare the coaxial cable 100 for attachment to a coaxial cable connector, a portion of the inner conductor 102 is exposed as illustrated in FIG. 1B. The jacket 110 is trimmed back so that a portion of the dielectric 104 (and metallic covering 106 if present) and braided outer conductor 108 are exposed. The braided outer conductor 108 is then folded back, or everted, over the jacket 110, exposing the dielectric 104 and the metallic covering 106.

Figure 1C:
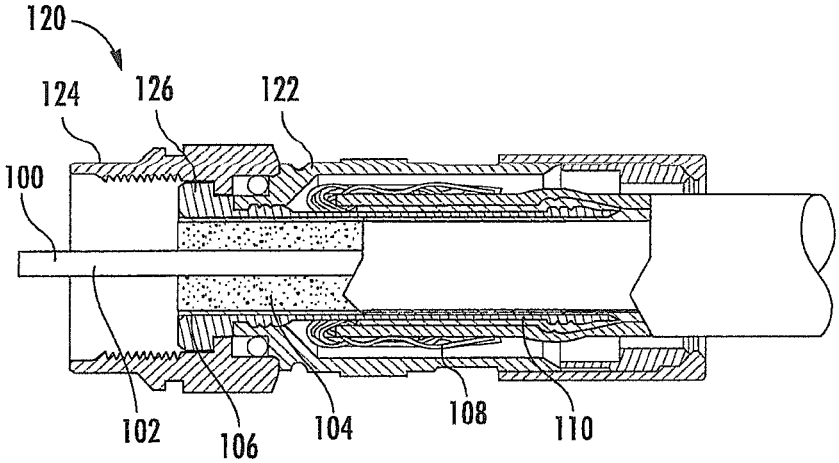
FIG. 1C PRIOR ART
FIG. 1C is a cross-sectional view of a conventional coaxial cable connector utilizing a post with a coaxial cable installed.

FIG. 1C illustrates a conventional coaxial cable connector 120 attached to the prepared coaxial cable of FIG. 1B. The coaxial cable connector 120 has a body portion 122 and a coupling member 124 beyond which the inner conductor 102 extends. Inside the body portion 122 is a post 126. The post 126 is used to secure the coaxial cable 100 to the coaxial cable connector 120 and to establish grounding continuity between the braided outer conductor 108 and the coaxial cable connector 120. As can be seen in FIG. 1C, the post 126 is inserted into the coaxial cable 100 under the jacket 110 between the braided outer conductor 108 and the dielectric 104 and the metallic covering 106. As the post 126 is inserted under the jacket 110, the post 126 physically contacts the braided outer conductor 108, while an exposed length of the dielectric 104 and the metallic covering 106 extends into the post 126 beyond the end of the jacket 110. In this manner, the post 126 is in continuity with the braided outer conductor 108 and the metallic covering 106. Moreover, since the braided outer conductor 108 is folded back over the jacket 110, the body portion 122 also comes in contact with the braided outer conductor 108, resulting in the post 126 and the body portion 122 having electrical continuity with the coaxial cable 100 through the braided outer conductor 108 and/or the metallic covering 106. Since the coupling member 124 may be connected to one or both of the post 126 and the body portion 122, electrical continuity, and thereby grounding continuity, may be extended from the coaxial cable 100 through the coaxial cable connector 120 and to a terminal to which the coupling member 124 may couple.

When discussing coaxial connectors herein, unless otherwise specifically indicated by the text or context of the description, reference to "forward" or "front" shall be understood to mean or indicate toward the end of the coaxial cable connector that couples to a terminal, while reference to "rearward" or "rear" shall be understood to mean or indicate the end of the coaxial cable connector that receives a coaxial cable. In this regard, and as can be seen in FIG. 1C, the post 126 may extend from the coupling member 124 at a forward end of the coaxial cable connector 120 through the body portion 122 and, almost, right up to the rearward end of the coaxial cable connector 120 where the coaxial cable 100 is received by the coaxial cable connector 120. With this conventional coaxial cable connector 120, a substantial length of a rear portion of the post 126 must be inserted under the jacket 110 to adequately secure and stabilize the coaxial cable 100 prior to, during and after closing the coaxial cable connector 120 by compressing the coaxial cable connector 120 with a compression tool. However, sufficient length of the braided outer conductor 108 may have to be exposed and folded back rearwardly to establish and maintain grounding continuity as the post 126 is inserted under the jacket 110 and to also assure that grounding continuity is established and maintained during and after attaching the coaxial cable connector 120 to the coaxial cable 100.

Figure 2:
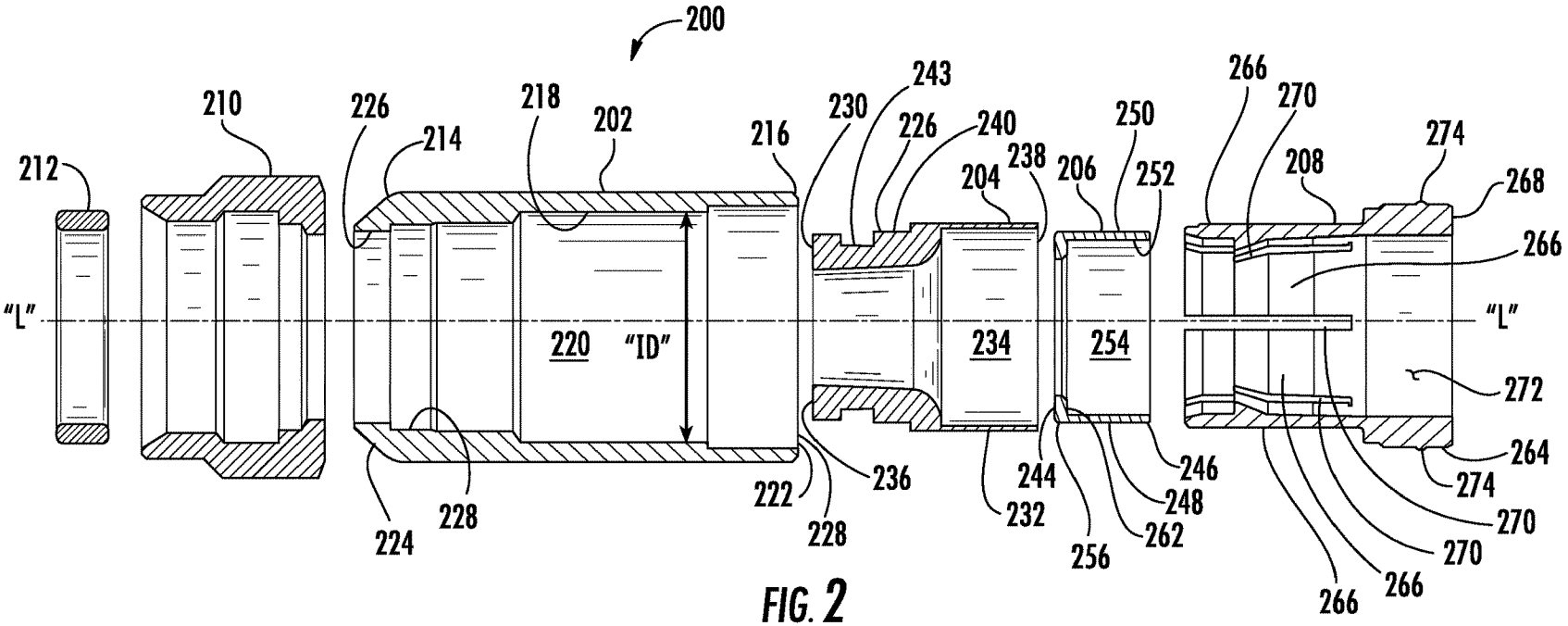
FIG. 2 is an exploded cross section of an exemplary embodiment of a post-less, self-gripping coaxial cable connector.
Figure 3:
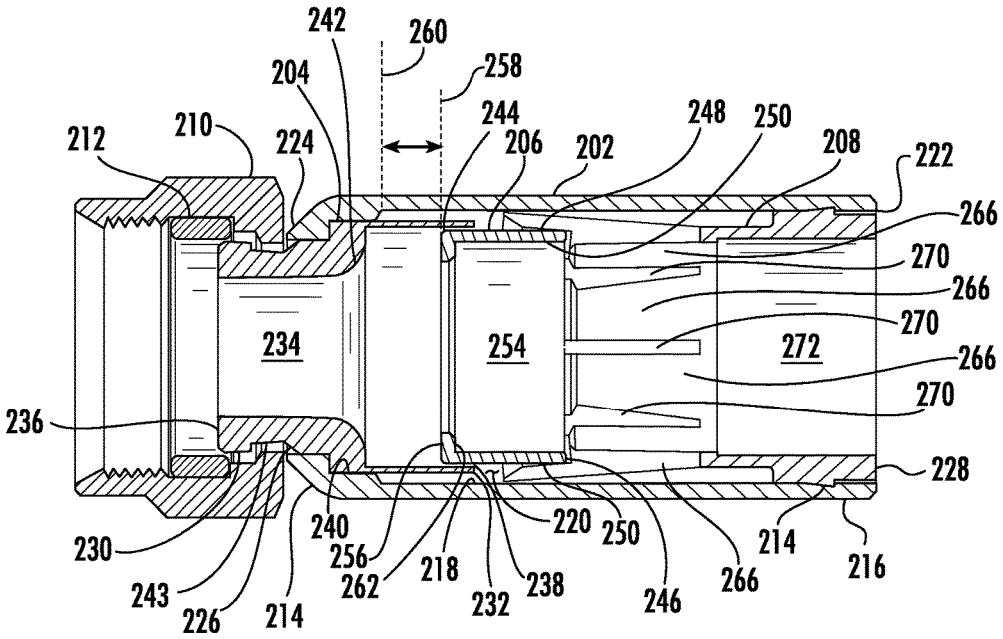
FIG. 3 is a cross section of the post-less, self-gripping coaxial cable connector of FIG. 2 in an assembled state and an open condition without a coaxial cable inserted therein.

Referring now to FIGS. 2 and 3, exploded and assembled cross-sections, respectively, of an exemplary post-less, self-gripping coaxial cable connector 200 are shown without a coaxial cable installed therein and with the post-less, self-gripping coaxial cable connector 200 illustrated in an open condition in FIG. 3. The post-less, self-gripping coaxial cable connector 200 may include a body 202, a retainer 204, a ring 206, a gripping member 208, a coupling member 210, and a gasket 212. Although in FIG. 2, all of the above mentioned components are shown as being centrally aligned on a common longitudinal axis "L", such an alignment for the components is not necessary. As illustrated in FIG. 2, the body 202 has a forward end 214 and a rearward end 216. An internal surface 218 extends between the forward end 214 and the rearward end 216, with the internal surface 218 defining a longitudinal opening 220. A cable receiving area 222 is proximal the rearward end 216 of the body 202 and a coupling area 224 is proximal the forward end 214 of the body 202. The internal surface 218 of the body 202 may form a forward opening 226 of the longitudinal opening 220 at the coupling area 224 proximal the forward end 214 of the body 202. The longitudinal opening 220 then may widen to a rearward opening 228 proximal the rearward end 216 of the body 202. The body 202 may be constructed from a thermoplastic polymer (polyoxymethylene), such as Acetal, as a non-limiting example.

The retainer 204 is positioned in the body 202 proximal the forward end 214 of the body 202. As illustrated in FIGS. 2 and 3, the retainer has a forward section 230, a rearward section 232, and a bore 234 extending through the retainer 204 along the longitudinal axis "L". The bore 234 comprises a transverse internal dimension generally orthogonal to the longitudinal axis "L", and wherein the transverse internal dimension of the bore 234 at the forward section 230 of the retainer 204 is less than the transverse internal dimension of the bore 234 at the rearward section 232 of the retainer 204. The bore 234 may open at the forward section 230 at a forward face 236 and at the rearward section 232 at a rear opening 238.

The forward section 230 may be friction fit to the internal surface 218 of the body 202 by an outward facing surface 240 of the retainer 204 contacting the inner surface 218 of the body 202 at the forward opening 226 of the body 202. The retainer 204 may include an interface 242 between the forward section 230 and the rearward section 232 of the retainer 204. As will be described in more detail below, the interface 242 may facilitate electrical continuity between the retainer 204 and the outer conductor of the coaxial cable. The retainer 204 may be constructed from metallic material, such as brass, as a non-limiting example, and plated with a corrosion resistant material, such as tin.

The coupling member 210 may be a nut or any other suitable device for coupling the post-less, self-gripping coaxial cable connector 200 to a terminal. In FIGS. 2 and 3, the coupling member 210 is depicted as a coupling nut rotatably attached to the retainer 204 at a channel 243 extending radially inwardly in the retainer 204. The channel 243 may be located rearward of the forward face 236 so that the forward face 236 positions in the coupling member 210. The coupling member 210 may be constructed of metallic material, for example brass, and plated with a corrosion resistant material, such as nickel. The gasket 212 may position in the coupling member 210 proximal the forward face 236 and provide an environmental seal to the post-less, self-gripping coaxial cable connector 200 when the coupling member 210 is attached to a terminal. The gasket 212 may be made from a resilient polymer material such as ethylene propylene diene monomer (EPDM), as a non-limiting example.

The ring 206 is movably disposed in the rearward section 232 of the retainer 204 through the rear opening 238 of the retainer 204. The ring 206 may include a first end 244, a second end 246, and side 248. The side 248 of the ring 206 extends from the first end 244 toward the second 246, and has an outer surface 250 and an inner surface 252. The inner surface 252 defines a hollow space 254 extending through the ring 206. The ring 206 also may include a pusher feature 256. The ring 206 is axially movable from a first location 258 to a second location 260, with the pusher feature 256 of the ring 206 configured to axially move the ring 206 upon force being applied to the pusher feature 256 by a coaxial cable received by the body 202. The first location 258 and the second location 260 are graphically illustrated in FIG. 3. It should be noted that the positions of the first location 258 and the second location 260 are only meant to graphically depict the first location 258 and the second location 260 and not to indicate any particular distance or direction between the first location 258 and the second location 260. As such, the depiction of the first location 258 and the second location 260 in FIG. 3 should not be understood or interpreted as excluding no axial distance between the first location 258 and the second location 260. The pusher feature 256 may be in the form of a flange 262, which projects radially inwardly from the inner surface 252 of the ring 206. The ring 206 may be constructed from a thermoplastic polymer (polyoxymethylene), such as Acetal, as a non-limiting example.

Figure 4:
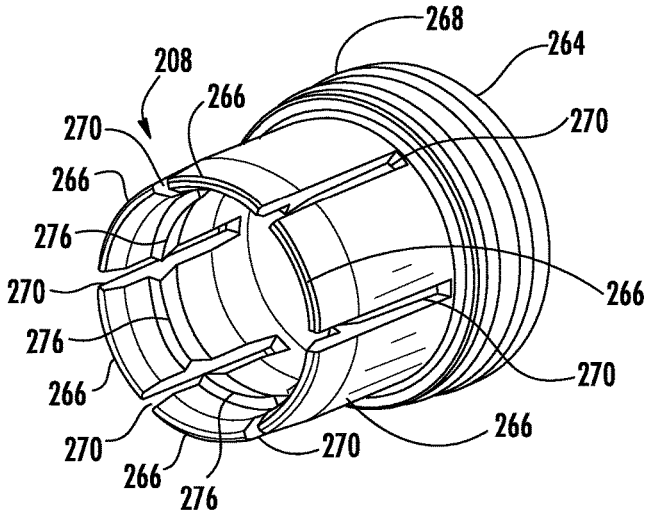
FIG. 4 is a front, perspective detail view of a gripping member of the post-less, self-gripping coaxial cable connector of FIGS. 2 and 3.

Referring now to FIG. 4 in addition to FIGS. 2 and 3, the gripping member 208 is friction fit to the body 202 proximal the rearward end 216. In this regard, the gripping member 208 may be stationary in the body 202 and, thereby, in the post-less, self-gripping coaxial cable connector 200. The gripping member 208 includes a base 264 and at least one spring finger 266 extending longitudinally from the base 264. The at least one spring finger 266 may be radially inwardly biased in a predisposed orientation. The base 264 of the gripping member 208 has an annular shoulder 268 extending radially outwardly from the base 264 so that the gripping member 208 may friction fit to the internal surface 218 of the body 202 at the annular shoulder 268. The at least one spring finger 266 may comprise a plurality of spring fingers 266, with a slot 270 separating adjacent ones of the plurality of spring fingers 266. Additionally, the gripping member 208 comprises an annular ridge 276 projecting radially inwardly from the plurality of spring fingers 266. The base 264 of the gripping member 208 has a cable passage 272 opening rearwardly at the cable receiving area 222 of the body 202 and extending forwardly to the at least one spring finger 266. A coaxial cable received by the post-less, self-gripping coaxial cable connector 200 may insert in and advance through the cable passage 272. The annular shoulder 268 has an outward barb 274, which contacts the internal surface of the body 202 to secure the friction fit of the gripping member 208 to the body 202. In FIG. 3, the at least one spring finger 266 is shown as engaging the outer surface 250 of the ring 206 when the ring 206 is in the first location 258. In this manner, the at least one spring finger 266 is forced radially outwardly. This will be discussed further with reference to FIG. 6 below. The gripping member 208 may be constructed of metallic material, such as brass, as non-limiting example, and plated with a conductive corrosion resistant material, such as nickel. Alternatively, the gripping member 208 may be constructed of a high-strength polymer, such as amorphous thermoplastic polyethermide (Ultem), Nylon, or the like, as non-limiting examples.

Figure 5:
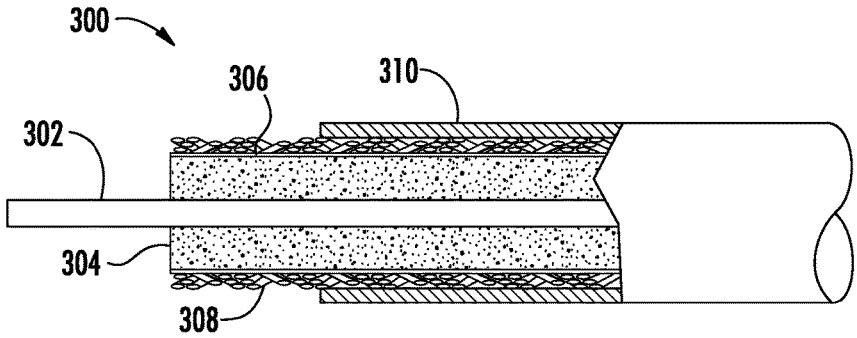
FIG. 5 is a partial cross-sectional view of a prepared coaxial cable using an exemplary method of preparation.

FIG. 5 illustrates a coaxial cable 300 in a prepared state for use with the post-less, self-gripping coaxial cable connector 200. The coaxial cable 300 is substantially like the coaxial cable 100 noted above, it is just different in how the cable end is prepared for use. As illustrated in FIG. 5, the coaxial cable 300 has a center conductor 302 that is surrounded by a dielectric layer 304. Coaxial cable 300 then has a braided outer conductor 308 which is covered and protected by a jacket 310. In FIG. 5, the dielectric layer 304 is not visible as it may be cut flush with, and, thereby covered by the braided outer conductor 308. The dielectric layer (or dielectric) 304 may also have a foil or other metallic covering 306 (also covered by braided outer conductor 308). The braided outer conductor 308 is illustrated as having a parquet-floor-like pattern, but it may be any outer conductor. The inner conductor 302 is exposed by removing the dielectric layer 304, the foil or other metallic covering 306, the braided outer conductor 308 and the jacket 310. A second portion of the coaxial cable 300 then has only the jacket 310 removed, leaving the dielectric layer 304, the foil or other metallic covering 306 and the braided outer conductor 308 intact. As noted above, the conventional method of preparing the coaxial cable 300 requires that the braided outer conductor 308 be folded back over the jacket 310. This preparation requires less time than the method of preparation of the coaxial cable 100.

Figure 6:
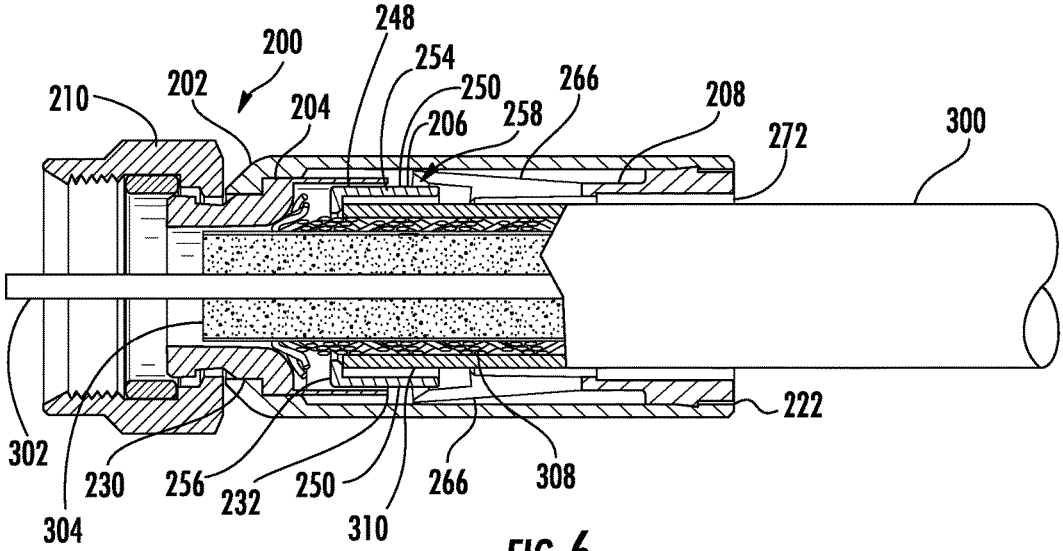
FIG. 6 is a cross-sectional view of the post-less, self-gripping coaxial cable connector of FIG. 3 in an open condition with the coaxial cable of FIG. 5 partially inserted therein.

Turning to FIG. 6, the post-less, self-gripping coaxial cable connector 200 is shown in an open condition with the coaxial cable 300 partially inserted therein. In the open condition, the post-less, self-gripping coaxial cable connector 200 may be understood as being in a first state. In the first state, the ring 206 is in the first location 258 with the side 248 of the ring 206 extended out from the retainer 204 positioned within the gripping member 208. The at least one spring finger 266 is engaged with the outer surface 250 of the ring 206 so that the at least one spring finger 266 is forced radially outwardly thereby. The body 202 is configured to receive the coaxial cable 300 at the cable receiving area 222 and allow the coaxial cable 300 to advance through cable passage 272 of the gripping member 208 and into the hollow space 254 of the ring 206 at the rearward section 232 of the retainer 204. The coaxial cable 300 advances through the hollow space 254 of the ring 206 so that the jacket 310 of the coaxial cable 300 contacts the pusher feature 256 of the ring 206 in the rearward section 232 of the retainer 204. The inner conductor 302, dielectric 304, and braided outer conductor 308 of the coaxial cable 300 advance from the rearward section 232 of the retainer 204 into the forward section 230 of the retainer 204. Additionally, the inner conductor 302 may extend into and through the coupling member 210.

Figure 7:
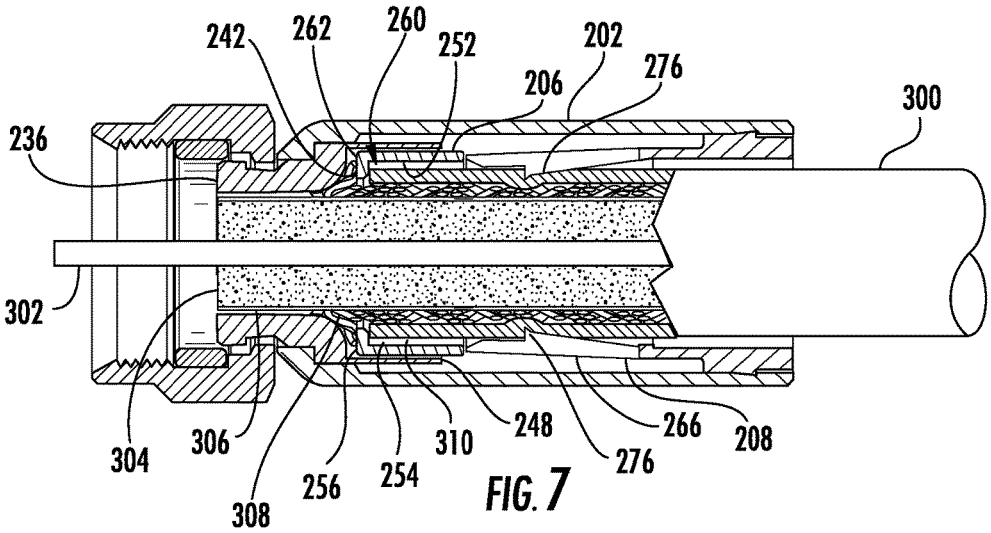
FIG. 7 is a cross-sectional view of the post-less, self-gripping coaxial cable connector of FIG. 3 in a closed condition with the coaxial cable of FIG. 5 installed therein.

Turning now to FIG. 7, in a second state, the jacket 310 of the coaxial cable 300 contacts the pusher feature 256 as the coaxial cable 300 advances in the hollow space 254 of the ring 206 and forces the pusher feature 256 of the ring 206 to move the ring 206 axially forwardly. The pusher feature 256 may be a flange 262 projecting radially inwardly from the inner surface 252 of the ring 206. The force of the jacket 310 on the pusher feature 256 forces the ring 206 to axially move to the second location 260 so that the side 248 of the ring 206 is positioned out of the gripping member 208 as the coaxial cable 300 is advanced in the body 202. The at least one spring finger 266 is disengaged from the outer surface 250 of the ring 206 and is allowed to move radially inwardly toward its predisposed orientation and the annular ridges 276 are configured to engage the jacket 310 of the coaxial cable 300. Additionally, the dielectric 304 of the coaxial cable 300 and the foil or metallic covering 306 of the coaxial cable 300 may position flush with the forward face 236 of the retainer 204. However, the interface 242 is configured to block further advance of the outer conductive braid 308 and facilitate electrical continuity with the outer conductive braid 308 at the interface 242. The inner conductor 302 extends forwardly of the forward face 236 of the retainer 204. In this manner, the post-less, self-gripping coaxial cable connector 200 may be tool-lessly attached to the coaxial cable 300.

Figure 8:
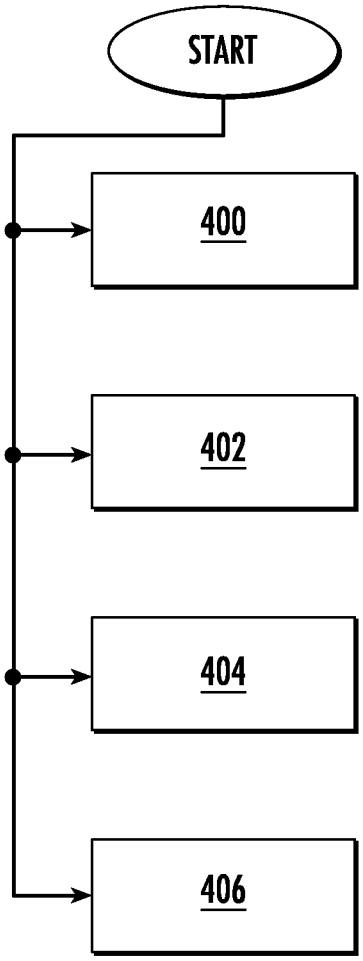
FIG. 8 is a flowchart diagram illustrating an exemplary process for preparing a coaxial cable and connecting the coaxial cable to the post-less, self-gripping coaxial cable connector of FIG. 3.

FIG. 8 depicts a method for preparing the coaxial cable 300 and connecting the coaxial cable 300 to the post-less, self-gripping coaxial cable connector 200. The method may be implemented by preparing a coaxial cable 300 by exposing a first predetermined length of the inner conductor 302, and a second predetermined length of the braided outer conductor 308, the braided outer conductor 308 covering the dielectric layer 304 (block 400); inserting the prepared coaxial cable 300 into a body 202 of the post-less, self-gripping coaxial cable connector 200 at a base 264 of a gripping member 208 friction fit to the body 202 proximal to a rearward end 216 of the body 202, the post-less, self-gripping coaxial cable connector 200 being in a first state (block 402); advancing the coaxial cable 300 through the base 264 of the gripping member 208 and through at least one spring finger 266 extending longitudinally from the base 264 of the gripping member 208 and into a ring 206 movably disposed in a first location 258 in a rearward section 232 of a retainer 204, the retainer 204 being friction fit to the body 202 at a forward end 214 of the body 202, the ring 206 including a pusher feature 256 for axially moving the ring 206 from the first location 258 to a second location 260 (block 404); and axially moving the ring 206 from the first location 258 to the second location 260 by the jacket 310 of the coaxial cable 300 forcing the pusher feature 256, the ring 206 in the second location 260 positioned in a forward section 230 of the retainer 204, the retainer 204 having a forward face 236 at the forward section 230, and the post-less, self-gripping coaxial cable connector 200 being in a second state, the dielectric 304 of the coaxial cable 300 and the foil or metallic covering 306 of the coaxial cable 300 positioned flush with the forward face 236 of the retainer 204, the inner conductor 302 extends forwardly of the forward face 236 of the retainer 204, an interface 242 of the forward section 230 and rearward section 232 of the retainer 204 blocks further advance of the braided outer conductor 308 and facilitates electrical continuity with the braided outer conductor 308 at the interface 242, and the at least one spring finger 266 engages the jacket 310 of the coaxial cable 300, to tool-lessly attach the post-less, self-gripping coaxial cable connector 200 to the coaxial cable 300 (block 406).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A post-less, self-gripping coaxial cable connector for tool-less attachment to an end of a coaxial cable, the coaxial cable comprising an inner conductor, a dielectric surrounding the inner conductor, an outer conductor surrounding the dielectric, and a jacket surrounding the outer conductor, the coaxial cable connector comprising:

a body having a forward end and a rearward end and a longitudinal opening therethrough;

a retainer positioned in the body, wherein the retainer comprises a forward section, a rearward section, and a bore extending therethrough;

a ring movably disposed in the rearward section of the retainer, the ring comprising a side having an outer surface, an inner surface, and a pusher feature; and a gripping member friction fit to the body proximal the rearward end, wherein the gripping member comprises a base and at least one spring finger extending longitudinally from the base, and wherein the at least one spring finger is radially inwardly biased in a predisposed orientation;

wherein the pusher feature of the ring is configured to axially move the ring upon force being applied to the pusher feature by a coaxial cable received by the body, and wherein the gripping member is configured to engage the jacket of the coaxial cable when the ring is axially moved such that the coaxial cable is installed in the coaxial cable connector, and wherein the coaxial cable connector is tool-lessly attached to the coaxial cable thereby.

2. The coaxial cable connector of claim 1, wherein the pusher feature comprises a flange, wherein the flange projects radially inwardly from the inner surface of the ring.

3. The coaxial cable connector of claim 1, wherein the base of the gripping member comprises an annular shoulder extending radially outwardly from the base, and wherein the gripping member is friction fit to an internal surface of the body at the annular shoulder.

4. The coaxial cable connector of claim 1, wherein the at least one spring finger comprises a plurality of spring fingers.

5. The coaxial cable connector of claim 4, wherein a slot separates adjacent ones of the plurality of spring fingers.

6. The coaxial cable connector of claim 4, wherein the gripping member comprises an annular ridge projecting radially inwardly from the plurality of spring fingers, wherein the annular ridges are configured to engage the jacket of the coaxial cable.

7. The coaxial cable connector of claim 1, wherein the retainer comprises an interface between the forward section and the rearward section.

8. A coaxial cable connector for attachment to an end of a coaxial cable, the coaxial cable comprising an inner conductor, a dielectric surrounding the inner conductor, an outer conductor surrounding the dielectric, and a jacket surrounding the outer conductor, the coaxial cable connector comprising:

a body having a forward end and a rearward end, wherein an internal surface extends between the forward end and the rearward end, the internal surface defining a longitudinal opening along a longitudinal axis, and wherein the body comprises a cable receiving area proximal the rearward end;

a retainer positioned in the body proximal the forward end of the body, wherein the retainer comprises a forward section, a rearward section, and a bore extending through the retainer along the longitudinal axis and opening at the forward section at a forward face and the rearward section at a rear opening, and wherein the forward section is friction fit to the internal surface of the body at the forward end of the body;

a ring disposed in the rearward section of the retainer, the ring comprising a side with an outer surface and an inner surface, the inner surface defining a hollow space extending through the ring, and a pusher feature, wherein the ring is axially movable from a first location to a second location;

a gripping member friction fit to the body proximal the rearward end, wherein the gripping member comprises a base and at least one spring finger extending longitudinally from the base, and wherein the at least one spring finger is radially inwardly biased in a predisposed orientation; and wherein, in a first state, the ring is disposed in the first location at the rear opening of the retainer with the side extending at least partially therethrough, and wherein the at least one spring finger is engaged with the outer surface of the side of the ring, and wherein the at least one spring finger is forced radially outwardly thereby; and wherein, in a second state, the ring is in the second location positioned out of the gripping member, and wherein the at least one spring finger is disengaged from the outer surface of the ring, and wherein the at least one spring finger is allowed to move radially inwardly to its predisposed orientation.

9. The coaxial cable connector of claim 8, wherein the ring is moved from the first location to the second location by force applied to the pusher feature.

10. The coaxial cable connector of claim 8, wherein the ring comprises a first end and a second end, wherein the pusher feature comprises a flange, wherein the flange projects radially inwardly at the first end of the ring, and wherein the side of the ring extends toward the second end of the ring.

11. The coaxial cable connector of claim 10, wherein the first end of the ring is positioned within the rearward section of the retainer in the first state and the second state.

12. The coaxial cable connector of claim 8, wherein in the second state, the ring is positioned axially more forward than when the ring is positioned in the first state.

13. The coaxial cable connector of claim 8, wherein the base of the gripping member comprises a cable passage, the cable passage opening rearwardly to the cable receiving area of the body and extending forwardly to the at least one spring finger.

14. The coaxial cable connector of claim 8, wherein the base of the gripping member comprises an annular shoulder extending radially outwardly from the base, wherein the gripping member is friction fit to an internal surface of the base at the annular shoulder.

15. The coaxial cable connector of claim 14, wherein the annular shoulder comprises an outward barb, wherein the outward barb contacts the internal surface of the body to secure the friction fit of the gripping member to the body.

16. The coaxial cable connector of claim 8, wherein the at least one spring finger comprises a plurality of spring fingers.

17. The coaxial cable connector of claim 16, wherein a slot separates adjacent ones of the plurality of spring fingers.

18. The coaxial cable connector of claim 16, wherein the gripping member comprises an annular ridge radially inwardly projecting from the plurality of spring fingers.

19. The coaxial cable connector of claim 8, wherein the bore comprises a transverse internal dimension generally orthogonal to the longitudinal axis, and wherein the transverse internal dimension of the bore at the forward section of the retainer is less than the transverse internal dimension of the bore at the rearward section of the retainer.

20. A post-less, self-gripping coaxial cable connector for tool-less attachment to an end of a coaxial cable, the coaxial cable comprising an inner conductor, a dielectric surrounding the inner conductor, an outer conductor surrounding the dielectric, and a jacket surrounding the outer conductor, the coaxial cable connector comprising:

a body having a forward end and a rearward end, wherein an internal surface extends between the forward end and the rearward end, the internal surface defining a longitudinal opening along a longitudinal axis, and wherein the body comprises a cable receiving area proximal the rearward end;

a retainer positioned in the body proximal the forward end of the body, wherein the retainer comprises a forward section, a rearward section, and a bore extending through the retainer along the longitudinal axis and opening at the forward section at a forward face and at the rearward section at a rear opening, and wherein the forward section is friction fit to the internal surface of the body at the forward end of the body;

a ring movably disposed in the rearward section of the retainer proximal the rear opening, the ring comprising a side and a pusher feature, wherein the side has an outer surface and an inner surface, the inner surface defining a hollow space extending through the ring, and wherein the side extends out from the rear opening of the retainer, and wherein the ring is axially movable from a first location to a second location by force applied to the pusher feature;

a gripping member friction fit to the body proximal the rearward end, wherein the gripping member comprises a base and at least one spring finger extending from the base, and wherein the at least one spring finger is radially inwardly biased in a predisposed orientation; and wherein, in a first state, the ring is in the first location and wherein the side of the ring extended out from the retainer is positioned within the gripping member, and wherein the at least one spring finger is engaged with the outer surface of the ring, and wherein the at least one spring finger is forced radially outwardly thereby, and wherein the body is configured to receive at the cable receiving area a coaxial cable and allow the coaxial cable to advance through the gripping member and into the ring at the rearward section of the retainer, and the jacket of the coaxial cable to contact the pusher feature of the ring in the rearward section, and the inner conductor, dielectric, and outer conductor of the coaxial cable to advance from the rearward section of the retainer into the forward section of the retainer;

and, wherein, in a second state, the ring is configured to axially move to the second location wherein the side of the ring is positioned out of the gripping member as the coaxial cable is advanced in the body, and wherein the dielectric of the coaxial cable and at least a portion of the outer conductor of the coaxial cable position flush with the forward face of the retainer, and wherein the inner conductor extends forwardly of the forward face of the retainer, and wherein the at least one spring finger is disengaged from the outer surface of the ring and is allowed to move radially inwardly toward its predisposed orientation and engage the jacket of the coaxial cable, and wherein the coaxial cable connector is tool-lessly attached to the coaxial cable thereby.

21. The coaxial cable connector of claim 20, wherein the pusher feature comprises a flange, and wherein the flange projects radially inwardly from the inner surface of the ring.

22. The coaxial cable connector of claim 20, wherein the retainer comprises an interface between the forward section and the rearward section.

23. The coaxial cable connector of claim 22, wherein the interface of the retainer is configured to facilitate electrical continuity between the retainer and the outer conductor of the coaxial cable.

24. The coaxial cable connector of claim 23, wherein the outer conductor of the coaxial cable comprises a foil and a braided outer conductor, and wherein an end of the conductive foil positions flush with the forward face of the retainer, and wherein the interface is configured to block further advance of the braid and facilitate electrical continuity with the braid at the interface.

25. A method for tool-lessly attaching a post-less, self-gripping coaxial cable connector to a coaxial cable, the method comprising:

providing a coaxial cable comprising an inner conductor, a dielectric surrounding the inner conductor, an outer conductor surrounding the dielectric, and a jacket surrounding the outer conductor;

preparing the coaxial cable by exposing a first predetermined length of the inner conductor, and a second predetermined length of the outer conductor, the outer conductor covering the dielectric;

inserting the prepared coaxial cable into a body of a coaxial cable connector at a base of a gripping member friction fit to the body proximal to a rearward end of the body, wherein the coaxial cable connector is in a first state;

advancing the coaxial cable through a base of the gripping member and through at least one spring finger extending longitudinally from the base of the gripping member and into a ring movably disposed in a first location in a rearward section of a retainer, the retainer being friction fit to the body at a forward section of the body, wherein the ring comprises a pusher feature for axially moving the ring from the first location to a second location;

axially moving the ring from the first location to the second location by the jacket of the coaxial cable forcing the pusher feature, wherein the ring in the second location is positioned in a forward section of the retainer, wherein the retainer comprises a forward face at the forward section, and wherein the coaxial cable connector is in a second state, wherein the dielectric of the coaxial cable and at least a portion of the outer conductor of the coaxial cable position flush with the forward face of the retainer, and wherein the inner conductor extends forwardly of the forward face of the retainer, and wherein the at least one spring finger engages the jacket of the coaxial cable, and wherein the coaxial cable connector is tool-lessly attached to the coaxial cable thereby.

* * * * *